US005727639A

United States Patent [19]

Jeter

[11] Patent Number: 5,727,639

[45] Date of Patent: Mar. 17, 1998

[54] PILE DRIVING HAMMER IMPROVEMENT

[75] Inventor: John D. Jeter, St. Martinville, La.

[73] Assignee: Lee Matherne, Houston, Tex.

[21] Appl. No.: 613,612

[22] Filed: Mar. 11, 1996

[51] Int. Cl.[6] ..... B25D 9/04

[52] U.S. Cl. ..... 173/132; 173/90; 173/126; 173/128; 173/200

[58] Field of Search ..... 173/89, 90, 91, 173/112, 115, 126, 128, 132, 133, 200, 202, 204, 206, 210, 211, 212, 162.1

[56] References Cited

U.S. PATENT DOCUMENTS

| | | | |
|---|---|---|---|
| 2,305,772 | 12/1942 | Haage | 123/46 R |
| 3,105,153 | 9/1963 | James, Jr. | 290/1 R |
| 3,267,677 | 8/1966 | Bollar | 173/128 |
| 3,679,005 | 7/1972 | Inaba et al. | 173/128 |
| 3,802,405 | 4/1974 | Haussman | 123/195 A |
| 4,293,045 | 10/1981 | Zeidman et al. | 173/126 |
| 4,421,180 | 12/1983 | Fleishman et al. | 173/132 |
| 4,860,835 | 8/1989 | Mauch | 173/128 |
| 5,065,824 | 11/1991 | Ottestad | 173/206 |
| 5,088,566 | 2/1992 | Gustafsson et al. | 173/206 |
| 5,567,867 | 10/1996 | Nazar | 173/90 |

*Primary Examiner*—Joseph J. Hail, III
*Assistant Examiner*—Jay A. Stelalone
*Attorney, Agent, or Firm*—John D. Jeter

[57] ABSTRACT

An improved pile driving drop hammer of the free piston internal combustion engine type preferably has integral pistons on each end of a ram that reciprocates, usually vertically, in an enclosing bore. There is a combustion chamber on each end of the bore and exhaust ports situated near each combustion chamber such that the ports are opened, two cycle engine fashion, by the associated piston, after some movement of the piston, after combustion takes place to vent the active combustion chamber and then serve as intake ports when the piston moves some distance farther along the bore. At each end of the bore an anvil extends from the bore, axially movable some amount, to serve as an end to each combustion chamber. The lower anvil delivers ram impact energy to the driven piling and the upper anvil delivers impact energy from the ram to a free rising mass that is the essential element of this invention as an improvement to existing hammer designs. The mass allows impact and combustion energy to be delivered to the downward movement of the ram without delivering lifting energy to the body. The mass rises and falls by gravity influence. Alternatively, a limited force means such as an air cylinder may apply a pull down force between the body and the mass to add some body weight to the ram energy. The down force is limited to an amount that will never lift the body off the driven piling. Controls are provided to time the fall of the mass to achieve advantageous cadence with the reciprocating ram.

14 Claims, 4 Drawing Sheets

PILE DRIVING HAMMER IMPROVEMENT

This invention pertains to pile driving drop hammers of the free piston internal combustion engine category utilizing a gravity dropped ram, with integral piston, and a combustion chamber at the lower end of a ram guiding bore in a ram confining body. The improvement applies to energy conserving means at the top end of the piston stroke provided by a floating seismic mass to receive energy from the ram at the top of the stroke to rise and fall in cadence with the ram to accept energy from the ram when the ram again returns to the top end of the stroke. Alternatively, the ram may utilize an upper end piston energized by a second, top end, compression chamber for igniting a fuel charge to contribute energy to both the seismic mass and the ram to improve the stalking power and the stroke rate of the composite hammer.

BACKGROUND

Drop hammers of the free piston internal combustion engine category have been in existence for over fifty years, primarily for driving pilings into the earth. The evolved designs most widely used have a ram of cylindrical shape moving axially in the bore of a body positioned by means, called leads or standards, resting on the piling being driven with the body at least partly supported by a lifting means. The lower end of the ram is a piston with piston rings. The lower end of the bore is a combustion chamber. The ram strikes an anvil also movable in the bore, and equipped with piston rings to confine the explosion of fuel in the combustion chamber. The anvil rests on the driven piling or a plate arrangement to conduct force to the piling. The impact between the ram and the anvil assists ignition of fuel injected into the combustion chamber before the ram strikes. The exploding fuel and air mixture drives the ram upward. When the ram has moved upward some amount, ports in the side of the bore are opened to atmosphere, typical of two stroke engines, when the piston clears the ports. The ram continues moving upward and draws atmosphere into the ports after the combustion pressure is exhausted. When gravity stops the rams upward movement it starts back down by gravity acceleration exhausting some foul air and exhaust mixture from the previous combustion. Finally the piston passes and closes the exhaust ports and compresses the entrapped air. In some hammers the fuel, usually diesel fuel, is cast into the bore before the piston closes the ports. In other cases the fuel is injected into the combustion chamber when the piston nears the anvil. The cycle described above is repeated until the fuel is shut off.

While running, the hammer may strike the piling in the range of forty times per minute. Axial forces derived from combustion and ram and anvil impact are not directly transmitted to the body. The axial forces act upon the ram, anvil and driven piling, not the body.

Driven pilings have a resistance to downward movement and when that resistance exceeds the impact force of the hammer utilizing a larger hammer is considered the normal way to proceed. There is a natural desire to get more striking force from a given size hammer and that has resulted in design efforts to produce more energy from the given hammer. That effort has resulted in various means to add some of the weight of the body to the downward force on the descending ram. Air ballast has been used to act against the top of the ram. That tends to lift the body off the driven piling. Double acting hammers have been built with upper combustion chambers that somewhat duplicated the combustion chamber below the ram. That upper chamber acts to lift the body and, if excessive, can lift the body off the driven piling with undesirable consequences. The bodies have been made heavier to accept the lifting force of the upper combustion chamber. The resulting double acting hammers then often weigh more and cost more than a larger single acting hammer with equal driving ability and the advantage is lost in terms of cost.

It is therefore an object of this invention to provide means to accept the upward force needed to oppose the ram at the top of the stroke without transferring all the force to the body.

It is another object of this invention to provide a seismic mass at the top of the body to receive the upward force and to freely move upward without transferring all the force to the body.

It is still another object to provide a seismic mass at the top of the hammer to return the energy invested in the lifted mass to the ram when the ram returns to the top end of the ram stroke to accelerate the downward movement of the ram.

It is another object to utilize the seismic mass to rise on impact with the ram in the absence of an explosion above the ram at the top of the stroke and to return the resulting energy to the ram when the ram again returns to the top of the ram stroke.

It is still another object to provide means to choose impact lifting of the mass or explosion lifting of the mass to satisfy changing conditions during hammer use.

These and other objects, advantages, and features of this invention will be apparent to those skilled in the art from a consideration of this specification, including the attached claims and appended drawings.

SUMMARY

An internal combustion powered pile driving hammer has a free piston ram moving axially in a bore in a body with a combustion chamber at opposite ends of the bore to act upon the ram to drive it reciprocally between opposite ends of the bore. Some distance from each end openings in the chamber provide exhaust ports from the bore to the atmosphere. The same ports admit intake air to the related combustion chamber. Fuel injectors inject fuel into the combustion chambers when the ram end approaches the ends of its excursion. The fuel ignites, preferably by diesel action, to power movement of the ram. At the lower end of the ram stroke it impacts an anvil that is axially movable, within limits, to convey ram impact to a piling to be driven. The body lowers by way of a suspension system, normally called a lead system, and the anvil is pushed back into the body by the piling being driven. At the upper end of the ram excursion it strikes a similar anvil that is also axially movable, within limits, but it conveys ram impact forces to a seismic mass that is free to rise upwardly, independently of the body except with control guidance but without axial resistance. If the upper combustion chamber is fueled and fired when the ram is in the upper limit of travel part of that energy is also conveyed to the mass and further contributes to the downward acceleration of the ram.

The seismic mass falls back to the starting position under the force of gravity and, ideally, strikes the anvil at the same time the rising ram strikes the anvil. The energy invested in the mass then is conserved in that it is contributed to the ram to add to its downward momentum. Between the upper anvil and the mass a resilient means provides some spring action to the mutual impact between ram and mass. That resilient means rises with the mass to contribute to its energy conserving ability and may comprise buffer plates or a leaf spring arrangement that is part of the mass.

Suitable fuel injectors are in the art and may be operated by contact of an injector drive member with a feature on the ram or it may be powered by gases from the compression process at the related end of the body.

To reduce the needed weight of the mass, means can be provided to apply some of the body weight to the mass as a resilient downward force applied by a spring arrangement or an air cylinder. Force applied in this manner can be limited to only a portion of the body weight so that the body is never lifted. The power contributed by such force is proportional to the force times the total distance the mass moves in both directions. Use of body derived force shortens the lift distance of the mass and cadence with the ram may have to be forced by a timing mechanism. Such timing mechanism is provided and derives timing from the ram position. The cadence control is made responsive to the ram positions by either direct contact sensors or gas pressure sensors and are selective for both the ram position and direction of ram movement.

BRIEF DESCRIPTION OF DRAWINGS

In the drawings wherein like features have similar captions.

DETAILED DESCRIPTION OF DRAWINGS

Drop hammers have been built with features identical with those disclosed herein with the exception of the free mass that is movable in response to the delivery of energy to the ram at the top of the stroke. The free mass prevents transfer of forces to the body 1 when combustion forces are applied to the ram 2 to propel it downward. Drop hammers are used in conjunction with some form of standard or guide system to control the operating hammer. In petroleum related work it is called a lead system. Such guide apparatus is not related to points of novelty in this disclosure and no such system is shown. Fuel injectors have characteristics based upon choices of features related to the fuel and hammer characteristics. Such injectors are well established in the art and no details are shown.

Figure 1:
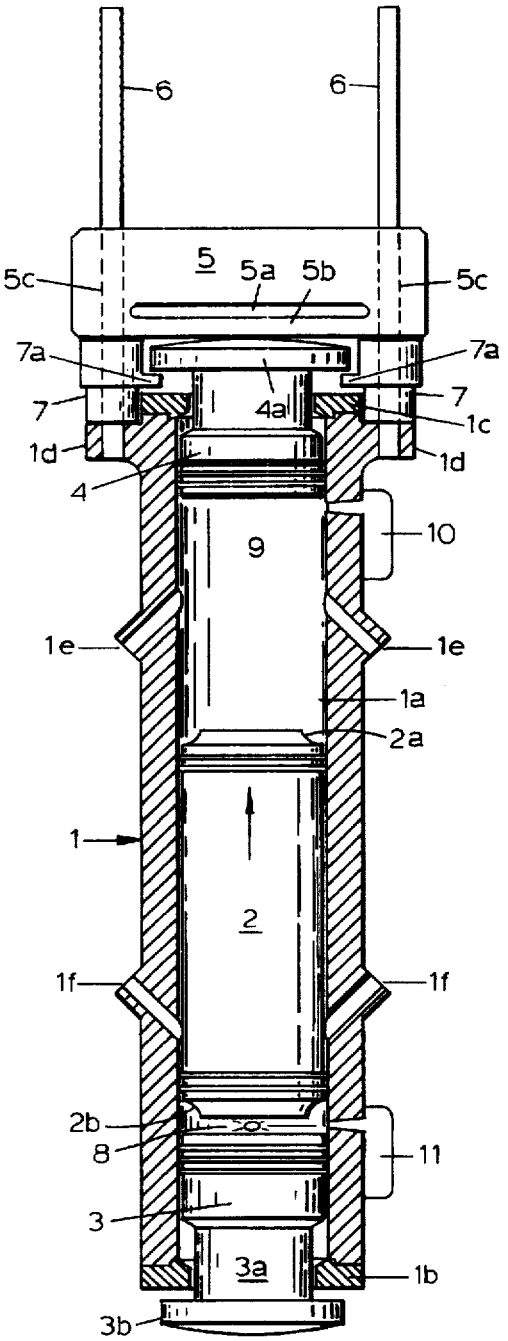
FIG. 1 is a side view, mostly in cut away, of the hammer assembly in a starting situation.

In FIG. 1 body 1 has bore 1*a* which carries ram 2 which reciprocates axially to strike anvils 3 and 4 in response to combustion of fuel and air in combustion chambers 8 and 9. The system is a two stroke cycle engine and exhaust ports 1*e* and 1*f* serve as exhaust ports when the piston ends 2*a* and 2*b* uncover the ports after combustion in the related combustion chamber. After the ports open and the pressure is vented the ram continues moving and the ports intake air. When the ram reverses direction, the open ports expel air until the related piston closes the port. and the trapped gas is compressed in preparation for firing when fuel is injected.

The injectors 10 and 11 can be operated by any source of energy and timing but they are not part of this invention and are not described in detail.

Starting the hammer normally involves raising the ram from the lower position in the bore 1*a* and dropping it to compress gasses in combustion chamber 8 and injecting fuel. Various lifting devices are in the art including injecting air into chamber 8 to blast the ram upward. Lifting devices are not part of this invention and are not shown.

Novel features include the mass 5, anvil 4, guides 6 and upper anvil positioners 7. Related parts include guide supports 1*d* and anvil lift lugs 7*a*.

Anvils 3 and 4 are retained on the body by split plates 1*b* and 1*c* respectively. They have bores that accept the reduced diameters of the anvils such as 3*a* on anvil 3. The plates are bolted to the body but no bolts are shown in the drawings. Anvil 3 delivers the productive output of the hammer and normally rests on a driven piling. Anvil 4 delivers the force resulting from impact with the ram and explosion in chamber 9 to the mass 5 without transferring axial loads to the body.

Figure 2:
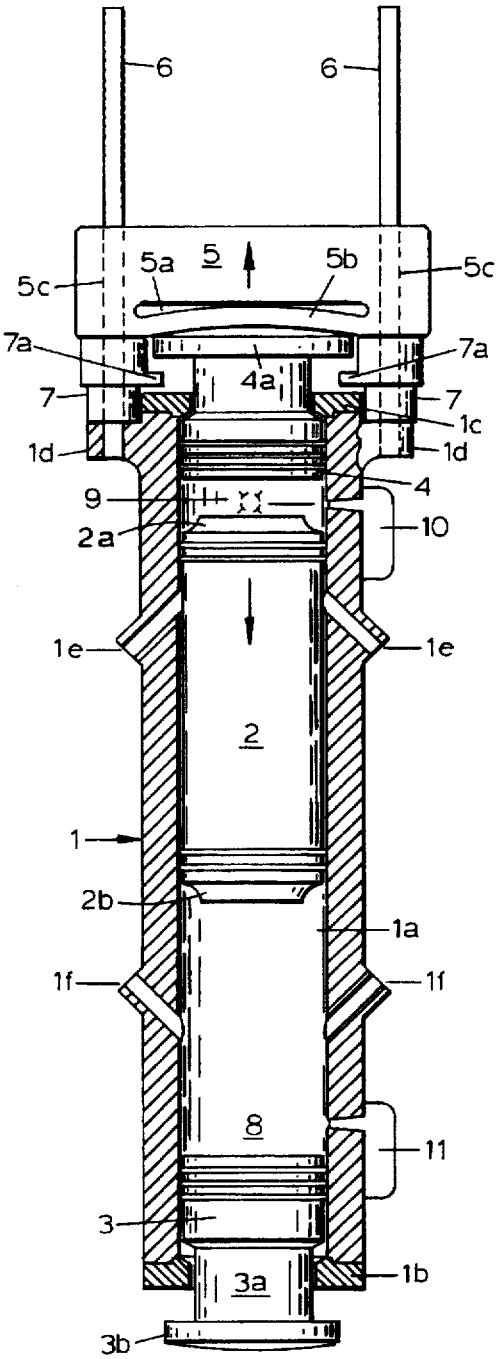
FIG. 2 is identical to FIG. 1 after a brief time lapse to allow moving members to achieve a significant relationship change.

In functional order, starting with FIG. 1, the compressed gas in chamber 8 is used with fuel injected from injector 11 to provide combustion to drive ram 2 upward as shown by the arrow. In FIG. 2 the ram strikes anvil 4 driving it into mass 5, deflecting spring member 5*b* to the limit provided by slot 5*a*. Mass 5 has started moving upward and the ram 2 has started its downward excursion. The fuel from injector 10 can be sprayed into chamber 9 before or after impact between ram and anvil.

Figure 3:
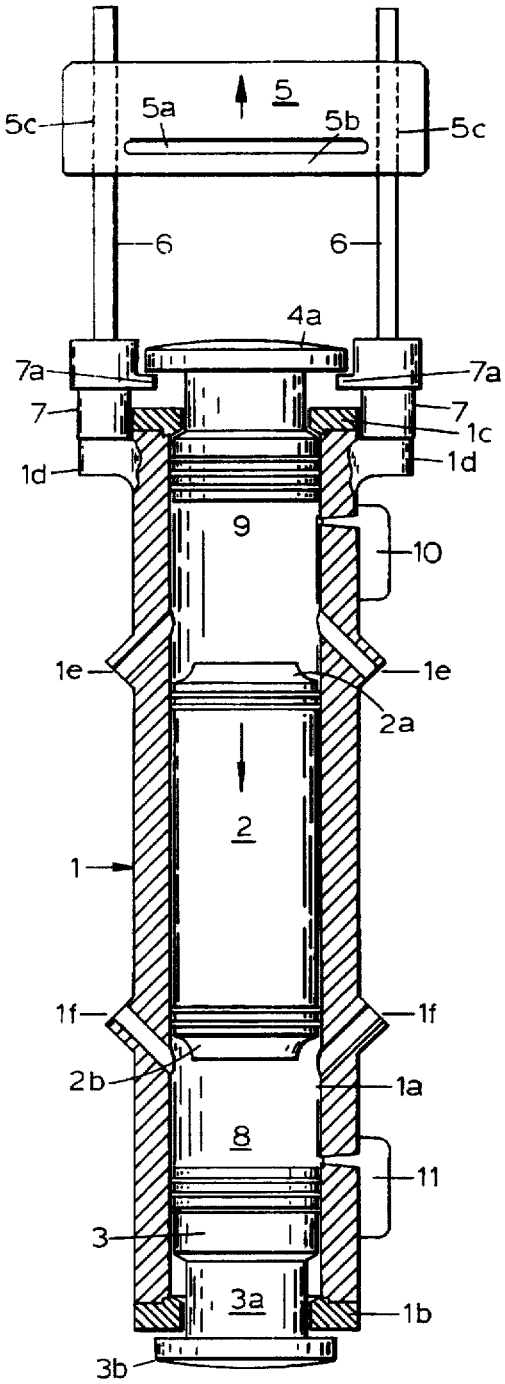
FIG. 3 is identical to FIG. 2 after a short time lapse to allow significant features to further change relationships.

In FIG. 3 the mass 5 has moved upward on guides 6. Spring loaded anvil positioners 7 have extended and lugs 7*a* support anvil 4. Ram 2 is approaching the anvil 3.

Figure 4:
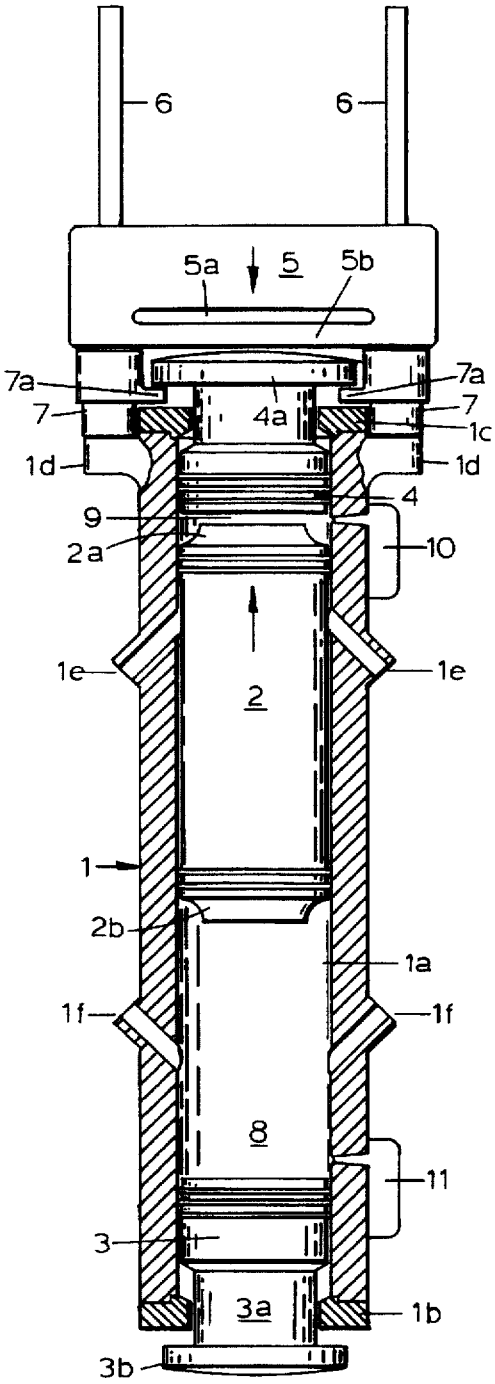
FIG. 4 is identical to the first three figures after most of a full cycle of events have occurred.

In FIG. 4 the ideal timing between ram and mass is shown. The mass has nearly completed its down stroke and has moved shock absorbers 7 down so that anvil 4 can move axially to transfer forces between ram and mass. The ram is moving upward. The energy remaining in the ram velocity depends upon the throttle setting for injector 11. The explosion to follow in chamber 9 will determine the energy invested in ram velocity on the down stroke and will determine the height of rise of mass 5. The greater the energy in the combustion in chamber 9 the longer it will take for mass 5 to make a round trip and the shorter will be the time for the ram to make a round trip. Timing to bring ram and mass to the preferred relative positions at the top end of the ram stroke, then, is largely influenced by the upper combustion energy and relative weights of mass and ram.

Figure 5:
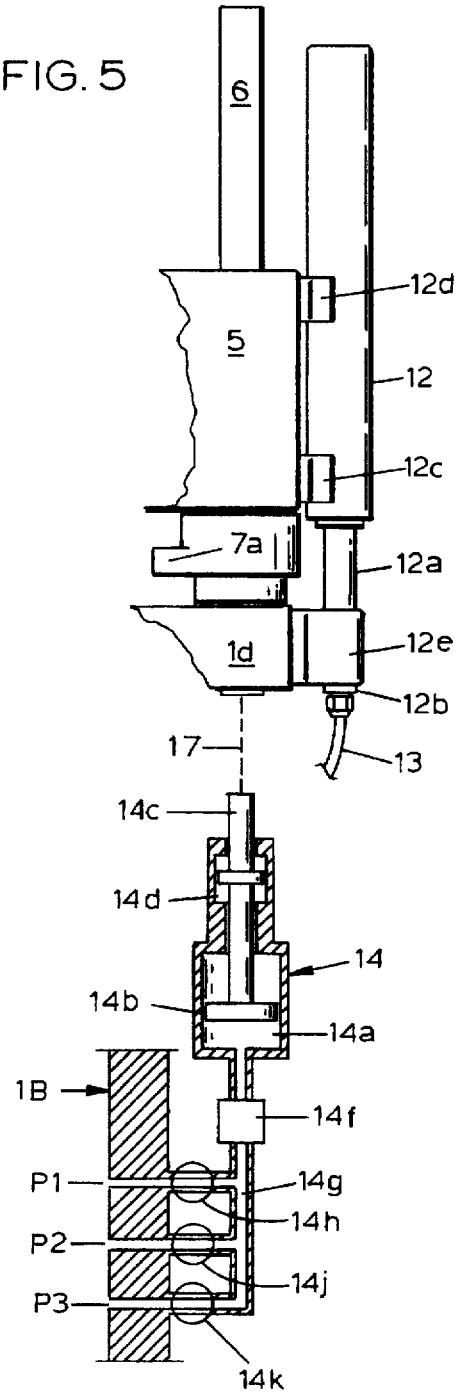
FIG. 5 is a front view of part of the hammer structure, supplemented by some schematic layout, adapted to apply some of the body weight to the seismic mass and to force cadence between mass and ram.

In FIG. 5 bias means for applying some downwardly directed force from the body to the mass is disclosed. An air cylinder 12, supported on the mass by mounts 12*c* and 12*d*, is shown as a pull down device with rod 12*a* attached to the body by bracket 12*e*. Air pressure is injected by tube 13 into rod end 12*b* to avoid tube attachment to the moving mass. This shortens the upstroke of the mass and contributes to the ability of the operator to optimize cadence between ram and mass. By adjusting the air pressure in the pull down cylinder the fuel volume setting for the upper injector can be changed without deranging existing cadence parameters.

A cadence control system 14 is schematically shown on FIG. 5. It operates a cadence latch shown in detail in FIG. 6. By way of linkage 17, piston 14*b* in cylinder 14 operates a latch in guide rod 6 to support mass 5 at any height on the rod. The wall of body 1 with the port adaptation, now defined as 1 B, has ports P1, P2, and P3 located to tap pressure from the body bore below exhaust ports 1*f* and anvil 3. Pressure from the ports can be selectively valved to open into manifold 14*g* by valves 14*h*, 14*j*, and 14*k*. Pressure relief valve 14*f* controls flow of gas into cylinder 14*a* to move piston 14*b*. Piston rod 14*c* has an oil filled dash pot piston in bore 14*d* to prevent prompt latching of the mass. The ram piston rings move past at least ports P1 nd P2. This arrangement permits piston 14*b* to be moved in response to selected positions of the ram in terms of both axial location and direction of movement. On the ram down stroke only compression pressure is available and any or all ports can be open because compression in proportional to ram position and the relief valve will allow gas to flow above a selected pressure, hence, at selected ram positions. When the charge fires in the combustion chamber the ram piston rings are below at least ports P1 and P2. On the ram upstroke, combustion pressure will always open the valve 14*f* and the choice of valves opened of the set 14*h*, 14*j*, or 14*k* will determine at what ram position the piston 14*b* responds. The cadence forcing latch, operated by linkage 17, can therefore be timed over a wide range of ram positions.

Combustion gases tend to foul machinery operated by such gas and raise maintenance problems. The same function, for timing purposes, is accomplished by the device of FIG. 6. A housing blister is formed on the body, now defined as 1A, and a ring 2Ag is cut around the midriff of the ram, now defined as 2A. Mount 24 is vertically adjustable and supports pivot 23. Toggle lever 20 is mounted on pivot frame 19 which pivots about pivot 23 and it is biased by spring 22 to the position shown. When pivot frame 19 moves it moves rod 18 and related linkage 17. Toggle lever 20 is positioned to respond to upward movement of the ram. When the ram 2A moves downward it only slightly moves the frame 19 and does not influence the cadence latch. When the ram moves upward, frame 19 is substantially moved about pivot 23 and rod 18 moves to actuate the latch.

Figure 6:
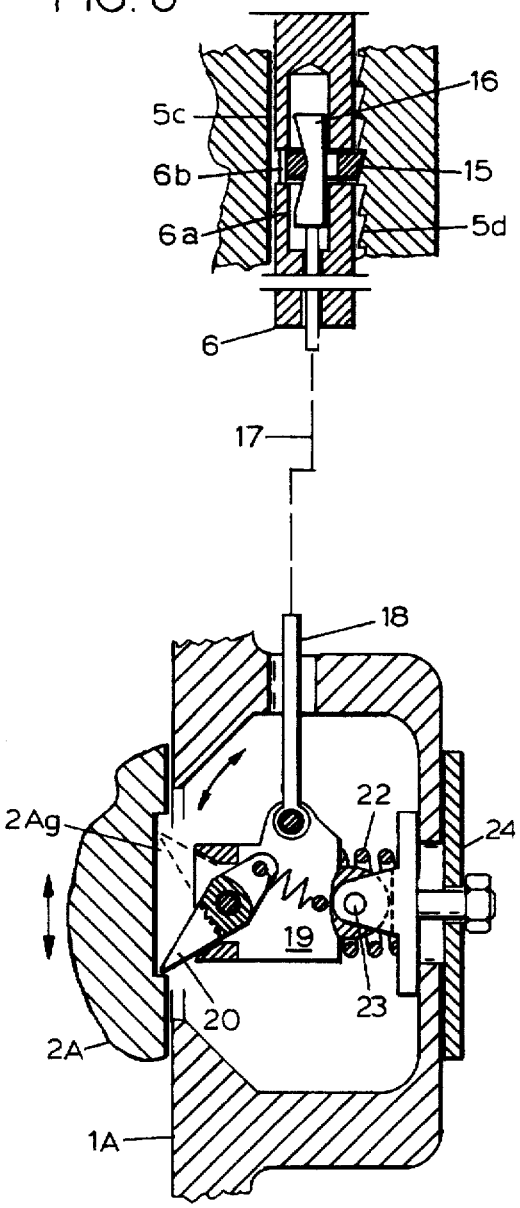
FIG. 6 is primarily a schematic display of machine elements to use ram positions to force cadence between the ram and the mass.

The cadence latch system in the upper part of FIG. 6 is of reduced scale compared with the lower portion and it is mostly contained within rod 6. Only one rod is shown for simplicity but both rods 6 are identical for balanced operation. Within rod 6, bore 6*a* contains latch actuator double wedge 16 which releases the latch 15 when moved a significant amount in either vertical direction. A transverse bore 6*b* carries latch tang 15. Bore 5*c* in mass 5 is fitted with notches 5*d* to cooperate with tang 15. The notches are present throughout most of the travel range of the mass and allow tang 15 to arrest the mass at any significant height. Latching will always occur, if used, when the mass has ceased upward movement to avoid shocking the latch system. When natural cadence is achieved the tang is moved to the unlatched state before the mass starts downward movement.

Wedge 16 pulls in tang 15 whether moved up or down a substantial amount. To change the system to respond to downward movement of the ram the toggle 20 is flipped upward as shown by dashed lines. The major response to ram movement is then a major downward tilt of frame 19 when the groove 2Ag moves downward. The vertical adjustment of mount 24, and the toggle position selection permits a wide range of choice in timing between the ram and the cadence latch.

Maximizing the driving power of the hammer is obviously a matter of achieving optimum cadence between mass and ram. Not so obvious is the soft driving option offered by deliberate mis-timing of ram and mass cadence. When pilings are started in soft formations the travel limit of anvil 3 may be destructively overrun by a full stroking ram. In such cases the ram is only slightly driven upward by reducing fuel injected by injector 11. As driving proceeds and piling resistance increases the ram can be allowed to hit the anvil 4 and move mass 5 upward without injecting fuel into chamber 9. The mass will fall back to the starting position before the ram returns on the upstroke. The mass will deliver the invested energy to the body by way of anvil positioners 7 and the body will deliver the energy to the piling by way of the anvil 3. By selecting the throttle setting for injector 11 the blow delivered by the mass can be spaced between blows delivered by the ram by which the soft blow delivery rate is doubled. By different throttle setting, the mass can be timed to deliver its blow to the body at the same time the ram blow to anvil 3 is delivered. That timing can increase the driving ability of each blow. That driving ability increase depends somewhat upon a resilient body between the anvil 3 and the body as shown in figure 8.

Figure 8:
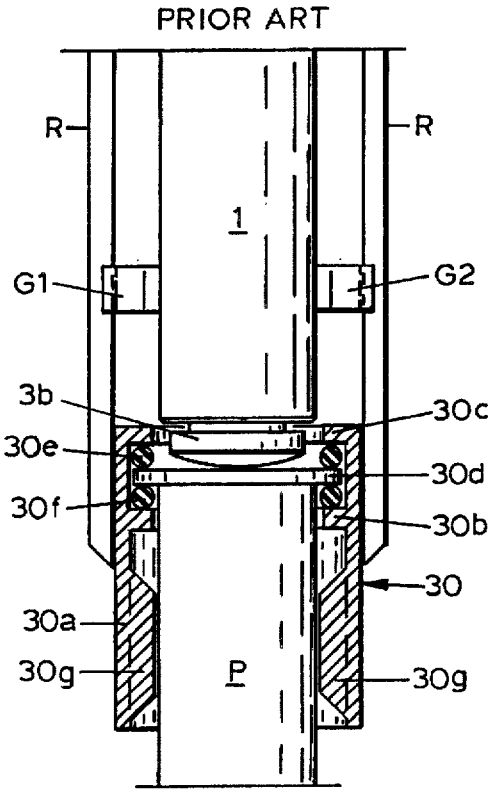
FIG. 8 is a side view, mostly cut away, showing part of the usual lead system not part of this invention but incidental to the normal driving rig.

In FIG. 8 part of a common lead system used with hammers is shown. The lead system, not part of this invention, aligns the hammer and the piling being driven and allows the hammer to be lowered in an orderly manner as the piling is driven down. The lead 30 has tube 30*a* with fins 30*g* to slip over piling P. Plate 30*d* sits atop the piling P with anvil head 3*b* resting thereon. Resilient rings 30*e* and 30*f* allow the anvil to shock the plate 30*d* without transferring the total shock to the lead system. The hammer body 1 can slide down on the lead system by way of guides G1 and G2 on vertical rails R. Rings 30*b* and 30*c* position the resilient rings and the body moves down by its weight to push the anvil upward into the body. The system is often used without ring 30*f*.

Figure 7:
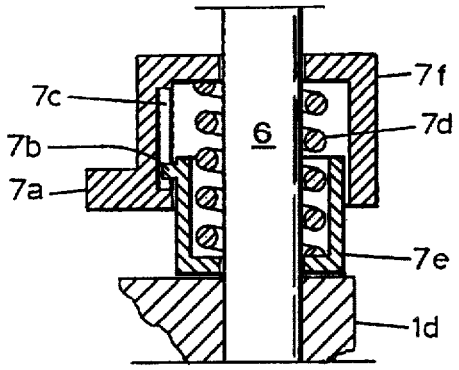
FIG. 7 is a side view, in cut away, of part of the upper anvil positioning device.

FIG. 7 shows anvil positioner 7 in position around bar 6 atop the body 1*b* and in the extended state. Lower portion 7*e* houses spring 7*d* which pushes cap 7*f* to an upper limit controlled by lug 7*b* in groove 7*c* to lift the lug 7*a* to support the upper anvil. There are two positioners, one for each rod 6. Use of the positioner provides some latitude in cadence timing without shocking the body by impact of a slightly mis-timed falling mass.

The term "vertical" in the specification and claims is a convenience in describing configuration and gravity forces. Pile driving hammers rarely operate exactly vertical and no such limitation should be construed from use of the term.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the tool of this invention without departing from the scope thereof, it is to be understood that all matter herein set forth or shown in the accompanying drawings is to be interpreted as illustrative and not in a limiting sense.

The invention having been described, I claim:

1. An improved pile driving drop hammer of the free piston internal combustion type, comprising:

a) a body with a ram confining generally cylindrical vertical bore;

b) a generally cylindrical ram situated in said bore, for axial movement therein between upper and lower travel limits, with an integral piston situated on at least a lower end;

c) an anvil secured to said body to extend downwardly from said bore for limited vertical movement to deliver vertical blows to a driven piling when said piling is situated below said anvil;

d) a closed combustion chamber defined by said bore, said piston, and said anvil;

e) injector means situated to inject fuel into said bore between said ram and said anvil;

f) ports opening from outside said body into said bore for movement of gases between said bore and the atmosphere around said body, said ports situated to be opened and closed by said piston when said piston moves between said travel limits;

the improvement comprising:

g) a mass situated on said body for axial movement, between an upper and a lower limit, with guidance thereon and situated to receive impact energy from said ram when said ram approaches said upper limit of said travel and to rise against gravity forces to expend energy received from said impact energy and to return under the influence of gravity.

2. The improved hammer of claim 1 wherein an upper anvil is situated to extend upward from said bore, for limited axial movement therein, to deliver impact energy from said ram to said mass.

3. The improved hammer of claim 2 wherein a resilient means is interposed between said anvil and said mass to convey at least part of said impact energy therebetween.

4. The improved hammer of claim 1 wherein latch means is situated to act between said body and said mass to suspend said mass after some upward movement, said latch provided with actuation linkage responsive to the position and direction of movement of said ram to release said latch to allow said mass to fall when said ram reaches a preselected location with a preselected direction of movement.

5. The improved hammer of claim 2 wherein an upper combustion chamber is provided, a piston with piston rings made integral with an upper end of said ram, piston rings situated on said upper anvil to cooperate with said bore, exhaust ports provided some distance downward from said upper anvil to permit movement of gases between said bore and the atmosphere outside said body, and injector means is provided to inject fuel into said upper combustion chamber.

6. An improved free piston, internal combustion powered, pile driving hammer of the double acting type with an upper and a lower combustion chamber, comprising:

a) a body with a ram confining generally cylindrical vertical bore;

b) a generally cylindrical ram situated in said bore, for axial movement therein between upper and lower travel limits, with an upper ring fitted piston and a lower ring fitted piston on said ram;

c) a lower anvil secured to said body to extend downwardly from said bore for limited vertical movement to deliver vertical blows to a driven piling when said piling is situated below said anvil;

d) an upper anvil secured to said body for limited vertical movement, situated to extend upwardly from said bore to deliver impact energy from said ram to a mass situated above said upper anvil;

e) a closed lower combustion chamber defined by said bore, said ram, and said lower anvil;

f) a closed upper combustion chamber defined by said bore, said ram, and said upper anvil;

g) first injector means situated to inject fuel into said bore between said ram and said lower anvil;

h) second injector means situated to inject fuel into said bore between said ram and said upper anvil;

i) first exhaust ports opening from outside said body into said bore for movement of gases between said bore, below said ram, and the atmosphere around said body, said ports situated to be opened and closed by said lower piston when said ram moves between said travel limits;

j) second exhaust ports opening from outside said body into said bore for movement of gases between said bore, above said ram, and the atmosphere around said body, said ports situated to be opened and closed by said upper piston when said ram moves between said travel limits;

the improvement comprising;

k) a mass situated on said body for axial movement, between an upper and a lower limit, and guidance thereon situated to receive impact from said ram by way of said upper anvil when said ram impacts said anvil, and combustion energy derived from said upper combustion chamber when it is fired, and to rise against gravity forces to expend energy received from said impact, and any combustion energy in said upper chamber, and to return under the influence of gravity.

7. The improved hammer of claim 6 wherein resilient means is interposed between said upper anvil and said mass to convey at least part of said impact energy therebetween.

8. The improved hammer of claim 6 wherein latch means is situated to act between said body and said mass to suspend said mass after some upward movement, said latch provided with actuation linkage responsive to the position and direction of movement of said ram to release said latch to allow said mass to fall when said ram reaches a preselected location with a preselected direction of movement.

9. An improved pile driving drop hammer of the free piston internal combustion type, comprising:

a) a body with a ram confining generally cylindrical vertical bore;

b) a generally cylindrical ram situated in said bore, for axial movement therein between upper and lower travel limits, with an integral piston situated on at least a lower end;

c) an anvil secured to said body to extend downwardly from said bore for limited vertical movement to deliver vertical blows to a driven piling when said piling is situated below said anvil;

d) a closed combustion chamber defined by said bore, said piston, and said anvil;

e) injector means situated to inject fuel into said bore between said ram and said anvil;

f) ports opening from outside said body into said bore for movement of gases between said combustion chamber and the atmosphere around said body, said ports situated to be opened and closed by valves responsive to the position of said ram relative to said body;

the improvement comprising:

g) a mass situated on said body for axial movement, between an upper and a tower limit, with guidance thereon and situated to receive impact energy from said ram when said ram approaches said upper limit of said movement and to rise against gravity forces to expend energy received from said impact energy and to return under the influence of gravity.

10. The improved hammer of claim 9 wherein an upper anvil is situated to extend upward from said bore, for limited axial movement therein, to deliver impact energy from said ram to said mass.

11. The improved hammer of claim 10 wherein resilient means is interposed between said upper anvil and said mass to convey at least part of said impact energy therebetween.

12. The improved hammer of claim 10 wherein an upper combustion chamber is provided, a piston with piston rings is made integral with an upper end of said ram, piston rings are situated on said upper anvil to cooperate with said bore, exhaust ports are provided some distance downward from said anvil to permit movement of gases between said bore and the atmosphere outside said body, and injector means inject fuel into said upper combustion chamber.

13. The improved hammer of claim 9 wherein latch means is situated to act between said body and said mass to suspend said mass after some upward movement, said latch means provided with actuation linkage responsive to the position and direction of movement of said ram to release said latch means to allow said mass to fall when said ram reaches a preselected location with a preselected direction of movement.

14. The improved hammer of claim 12 wherein said exhaust ports are opened and closed by the upper piston when the upper piston passes the ports related to said upper combustion chamber.

* * * * *